US010150292B2

(12) United States Patent
Kanri et al.

(10) Patent No.: US 10,150,292 B2
(45) Date of Patent: Dec. 11, 2018

(54) LIQUID DISCHARGE HEAD, MANUFACTURING METHOD THEREFOR, AND RECORDING METHOD

(71) Applicant: CANON KABUSHIKI KAISHA, Tokyo (JP)

(72) Inventors: Ryoji Kanri, Zushi (JP); Yoshiyuki Fukumoto, Kawasaki (JP); Atsunori Terasaki, Kawasaki (JP); Tetsushi Ishikawa, Tokyo (JP); Masaya Uyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/602,798

(22) Filed: May 23, 2017

(65) Prior Publication Data

US 2017/0341390 A1 Nov. 30, 2017

(30) Foreign Application Priority Data

May 27, 2016 (JP) ..... 2016-106234

(51) Int. Cl.
*B41J 2/14* (2006.01)
*B41J 2/16* (2006.01)

(52) U.S. Cl.
CPC ..... *B41J 2/14129* (2013.01); *B41J 2/14* (2013.01); *B41J 2/14016* (2013.01); *B41J 2/14088* (2013.01); *B41J 2/162* (2013.01)

(58) Field of Classification Search
CPC ..... B41J 2/14129; B41J 2/14; B41J 2/14088; B41J 2/162; B41J 2/14064; B41J 2/14016
See application file for complete search history.

(56) References Cited

U.S. PATENT DOCUMENTS 5,485,185 A * 1/1996 Sueoka ..... B41J 2/14072 347/64

FOREIGN PATENT DOCUMENTS

| | | | |
|---|---|---|---|
| JP | 2002-347247 | A | 12/2002 |
| JP | 2004-74809 | A | 3/2004 |
| JP | 2006-227544 | A | 8/2006 |

* cited by examiner

*Primary Examiner* — Geoffrey Mruk
(74) *Attorney, Agent, or Firm* — Canon U.S.A. Inc., IP Division

(57) ABSTRACT

A liquid discharge head comprising a silicon substrate; an insulating layer A formed on a first surface of the silicon substrate, a protective layer A that includes metal oxide and is formed on the insulating layer A, the structure that is formed on the protective layer A by direct contact with the protective layer A, includes organic resin, and forms a part of a flow path for liquid, and an element that is formed on a second surface of the silicon substrate on a side opposite to the first surface, and is configured to generate energy used for discharging the liquid.

17 Claims, 12 Drawing Sheets

LIQUID DISCHARGE HEAD, MANUFACTURING METHOD THEREFOR, AND RECORDING METHOD

BACKGROUND OF THE INVENTION

Field of the Invention

The present disclosure relates to a liquid discharge head, a manufacturing method therefor, and a recording method.

Description of the Related Art

A liquid discharge head, such as an inkjet printer head, is provided with a supply path and a flow path so that liquid can flow to a substrate made of silicon and the like. Generally, the supply path and the flow path are formed by engraving holes in the substrate, or are formed as holes going through the substrate in some cases. The substrate is provided with a structure such as a flow path forming member and a discharge port forming member. In some cases, the flow path may form the discharge port. The substrate is further provided with an energy-generating element that generates energy for discharging liquid. More specifically, the liquid is provided with energy to be discharged through the discharge port. Japanese Patent Application Laid-Open No. 2006-227544 discusses one example of a method for forming the structure. More specifically, a method for forming a structure made of organic resin on a substrate is discussed. The method includes attaching a photosensitive resin film on a substrate having small recesses, and exposing and developing the film.

When the supply path and the flow path are formed on a silicon substrate, the silicon exposed on an inner wall of the supply path or the flow path may melt depending on the type of liquid to be used such as ink or a use condition. Especially, alkaline ink may pose a significant risk of melting the silicon. Even the slightest melting of the silicon into the liquid may affect a discharge performance and a formed image or collapse the flow path structure when used for a long period of time. Thus, various attempts have been made to protect the silicon exposed on the inner wall of the supply path or the flow path. Japanese Patent Application Laid-Open No. 2002-347247 discusses an example of a method for forming a protective layer including organic resin on a surface which is brought in contact with the liquid. Japanese Patent Application Laid-Open No. 2004-74809 discusses another example of a method for forming an ink-resistance thin film of titanium, a titanium compound, or alumina ($Al_2O_3$).

SUMMARY OF THE INVENTION

A liquid discharge head according to an aspect of the present disclosure includes a silicon substrate, an insulating layer A formed on a first surface of the silicon substrate, a protective layer A that includes metal oxide and is formed on the insulating layer A, a structure that is formed on the protective layer A by direct contact with the protective layer A, includes organic resin, and forms a part of a flow path for liquid, and an element that is formed on a second surface of the silicon substrate on a side opposite to the first surface, and is configured to generate energy used for discharging the liquid.

A manufacturing method for the aforementioned liquid discharge head according to an aspect of the present disclosure includes forming the insulating layer A on the first surface of the silicon substrate using Atomic Layer Deposition (ALD), forming the protective layer A on the insulating layer A, and forming the structure on the protective layer A.

A recording method according to an aspect of the present disclosure includes performing recording with liquid including pigment discharged through the aforementioned liquid discharge head.

Further features of the present disclosure will become apparent from the following description of exemplary embodiments with reference to the attached drawings.

DESCRIPTION OF THE EMBODIMENTS

The protection of the exposed silicon described above in Description of the Related Art, is preferably achieved with a metal oxide film as a protective layer in terms of preventing the melting of the silicon. However, if the metal oxide film is used as the protective layer, adhesion between a structure including organic resin, and the protective layer is weakened when the substrate is immersed in liquid for a long period of time, which may cause the peeling.

The present disclosure is directed to providing a liquid discharge head in which the peeling from the protective layer can be prevented even when liquid immersion continues for a long period of time.

[Liquid Discharge Head]

A liquid discharge head according to the present disclosure includes a silicon substrate, an insulating layer A formed on a first surface of the silicon substrate, a protective layer A that includes metal oxide and is formed on the insulating layer A, and a structure that is formed on the protective layer A by direct contact with the protective layer A and includes organic resin. The liquid discharge head further includes an element (hereinafter, also referred to as an energy-generating element) that is configured to generate energy used for discharging liquid and is formed on a second surface of the silicon substrate on an opposite side of the first surface. The structure forms a part of the flow path for the liquid. A configuration including the silicon substrate, the insulating layer A, the protective layer A, and the structure is hereinafter also referred to as a substrate. With the substrate provided in the liquid discharge head, the liquid can flow in the liquid discharge head for a long period of time without causing the peeling of the structure from the protective layer A.

Figure 1:
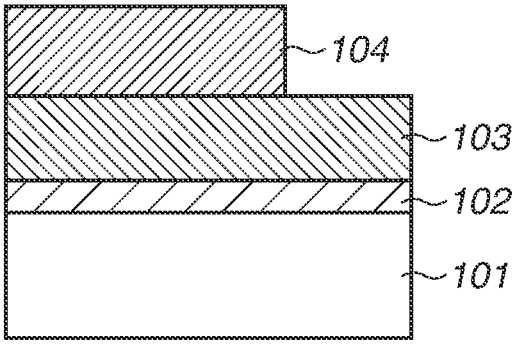
FIG. 1 is a cross-sectional view illustrating an example of a substrate.

An example of the substrate used for the liquid discharge head is described with reference to FIG. 1. As illustrated in FIG. 1, an insulating layer A 102 is formed on a silicon substrate 101. A protective layer A 103 including metal oxide is formed on the insulating layer A 102. A structure 104 including organic resin is formed on the protective layer A 103. The protective layer A 103 and the structure 104 are in direct contact with each other.

Figure 2A:
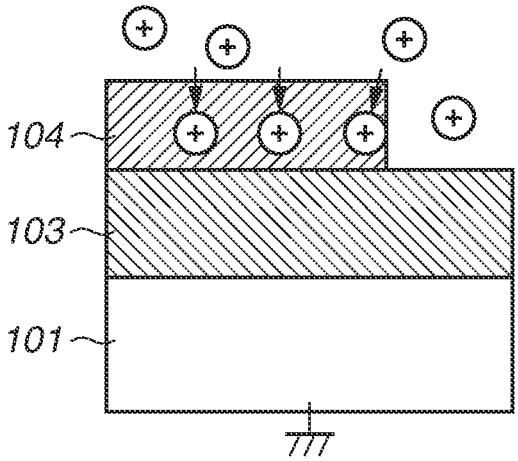
FIGS. 2A and 2B are cross-sectional views illustrating a presumed mechanism of peeling.
Figure 2B:
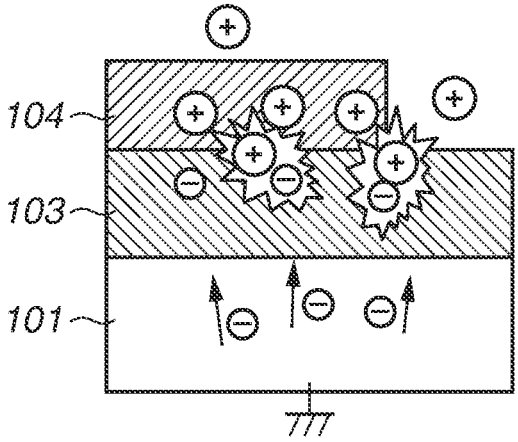

As described above, it is presumed that when the substrate comprising the protective layer A 103 including the metal oxide, and the structure 104 including organic resin, is immersed in liquid for a long period of time, the structure 104 is peeled from the protective layer A 103. FIG. 2 illustrates a mechanism of deterioration of the protective layer A 103 when the substrate is immersed in the liquid for a long period of time, which may cause the peeling. First, cations in the liquid enter the structure 104 including organic resin (FIG. 2A), together with water. The cations in the liquid may include alkaline metal ions such as Na and K and protons ionized in water. Liquid including pigment may contain an especially large amount of alkaline metal ions such as Na and K coming from resin used for dispersing the pigment. The cations and the water may enter through an interface between a pattern edge of the structure 104 and the protective layer A 103 or enter the structure 104 through permeation. The protective layer A 103 including the metal oxide is supplied with electrons as a carrier from the silicon substrate 101 that is grounded. The s protective layer A 103 includes metal oxide and thus exhibits semiconductor characteristics depending on a film forming condition and a use condition. Thus, the electrons as a carrier supplied from the silicon substrate 101, can move within the protective layer A 103. The metal oxide that is likely to exhibit the semiconductor characteristics includes titanium oxide, vanadium oxide, and zirconium oxide. The cations, which have entered the structure 104, and the electrons which have been supplied from the silicon substrate 101 and moved within the protective layer A 103, are recombined at the interface between the structure 104 and the protective layer A 103 and enter the metal oxide to deteriorate the surface of the protective layer A 103 (FIG. 2B). As a result, the adhesion between the structure 104 and the surface of the protective layer A 103 is deteriorated to result in the peeling. In fact, the deterioration of the protective layer A 103 was confirmed when the surface of the protective layer A 103 was observed where the peeling has occurred.

Figure 3A:
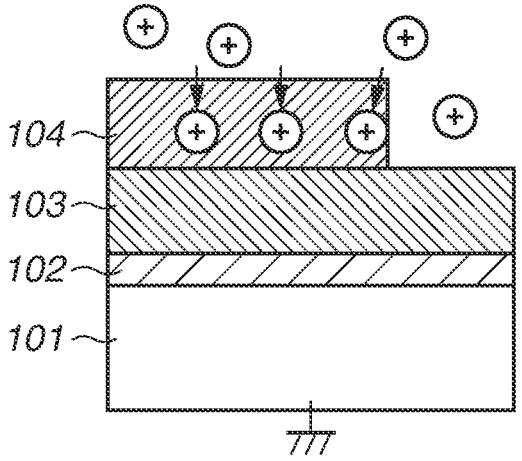
FIGS. 3A and 3B are each a diagram illustrating a presumed mechanism of preventing the peeling.
Figure 3B:
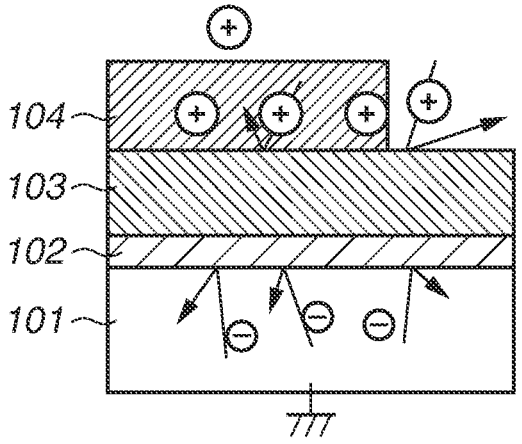

In view of the above, the insulating layer A is provided between the silicon substrate and the protective layer A. It is presumed that a mechanism illustrated in FIG. 3 can prevent the structure 104 from being peeled from the protective layer A 103, even when the substrate has been immersed in the liquid for a long period of time. The cations in the liquid enter the structure 104 including organic resin, together with water as in the case of FIG. 2A where no insulating layer A is present (FIG. 3A). On the other hand, the insulating layer A 102 prevents the electrons serving as the carrier from being supplied to the protective layer A 103 from the silicon substrate 101 that is grounded (FIG. 3B). Thus, the recombination of the cations and the electrons at the interface between the structure 104 and the protective layer A 103 can be prevented and the surface of the protective layer A 103 can be prevented from deteriorating. Therefore, it can be presumed that the structure 104 is prevented from being peeled from the protective layer A 103, even when the substrate has been immersed in the liquid for a long period of time.

A function element, driving circuit, a mechanical structure, and the like for a device employing the substrate according to the present disclosure, may be formed on the silicon substrate as appropriate. A driving circuit, a liquid supply path, a liquid flow path, and the like may be formed in advance on the silicon substrate in addition to the energy-generating element.

The insulating layer A has an insulating property and thus can prevent the electrons from being supplied from the silicon substrate. Thus, the recombination of the cations and the electrons at the interface between the structure and the protective layer A can be prevented. The insulating layer is a layer with a volume resistivity of $10^6$ Ωcm or more. In the present exemplary embodiment, the volume resistivity is a value calculated from a minute leakage current measured by a two-terminal method with an electrode formed on an appropriate film. The insulating layer A 102 is preferably made of a silicon compound containing at least one element selected from a group including oxygen, nitrogen, and carbon since the conditions described above can be easily satisfied. The silicon compound is preferably at least one type of compound selected from a group including SiO, SiN, SiOC, SiON, and SiOCN. Not only the silicon compound but also aluminum oxide such as AlO may be used. One type of such compounds may be used or a plurality of types of the compounds may be used.

Since it is thought that the electrical insulation between the silicon substrate and the protective layer A contributes to the prevention of the deterioration of the protective layer A, the insulating layer A is preferably used to prevent the silicon substrate and the protective layer A from being in direct contact with each other. More specifically, as illustrated in FIG. 1 for example, the insulating layer A 102 is preferably formed over the entire area between the silicon substrate 101 and the protective layer A 103 so that the silicon substrate 101 and the protective layer A 103 can be entirely separated from each other. Although the silicon substrate and the protective layer A are preferably prevented from being in direct contact with each other, the silicon substrate and the protective layer A may be in contact with each other as long as a contact portion is sufficiently separated to exceed a movable range of the carrier electrons. The volume resistivity of the insulating layer A is preferably larger than that of the protective layer A for the sake of the electrical insulation. More specifically, the volume resistivity of the insulating layer A is preferably larger than the protective layer A by 10 Ωcm or more and is more preferably larger than the protective layer A by $10^2$ Ωcm.

A method for forming the insulating layer A may be selected from deposition methods such as chemical vapor deposition (CVD), sputtering, and atomic layer deposition (ALD) as appropriate in accordance with a configuration of a portion where the insulating layer A is formed. Among these, the ALD which excels in terms of conformality is preferably employed since even when a mechanical structure with a higher aspect ratio such as the liquid flow path and the liquid supply path is formed, the insulating layer A can be formed over the entire wall surface. The thickness of the insulating layer A is not particularly limited as long as the insulation can be guaranteed, and is preferably 1 nm to 1 μm, more preferably 5 nm to 500 nm, even more preferably 10 nm to 300 nm, and is especially preferably 30 nm to 100 nm. The insulating layer A with a thickness of 1 nm or more can achieve a high reliability in terms of insulation. The insulating layer A with a thickness of 1 μm or can achieve a high productivity.

The protective layer A is a layer different from the insulating layer A, includes metal oxide, and has a function of preventing corrosion of the silicon substrate in a usage environment of the device. More specifically, in the liquid discharge head, Si of the silicon substrate is prevented from melting which is caused by discharged liquid. The metal element in the metal oxide is preferably titanium, zirconium, hafnium, vanadium, niobium, or tantalum and is more preferably titanium since high resistance can be achieved against corrosion caused by an alkaline solution. One preferable example of the protective layer A includes a TiO film. One type of the metal oxide may be used, however, two or more types of the metal oxide may be used together. The protective layer A preferably includes the metal oxide of 80% by mass or more, and more preferably includes the metal oxide of 90% by mass or more. It is even more preferable if the protective layer A includes the metal oxide of 100% by mass, that is, the protective layer A may be completely made of the metal oxide.

The deterioration of the protective layer A leads to a lower adhesion to the organic resin. Thus, in the present exemplary embodiment, the protective layer A and the structure are in direct contact with each other. The protective layer A may protect a portion in the surface of the exposed silicon substrate which affects the device performance and reliability when melted. Still, the protective layer A is preferably formed over the entire exposed surface of the silicon substrate in which the supply path and the flow path are formed. A method for forming the protective layer A may be selected from deposition methods such as CVD, sputtering, and ALD as appropriate in accordance with the configuration of the exposed silicon substrate surface. Among these, the ALD which excels in terms of conformality is preferably employed in forming the protective layer A. The thickness of the protective layer A is not particularly limited, and is preferably 5 nm to 500 nm, and is more preferably 10 nm to 300 nm.

The organic resin contained in the structure is preferably at least one type of resin selected from a group including epoxy resin, aromatic polyimide resin, aromatic polyamide resin, and aromatic hydrocarbon resin so that high mechanical strength and resistance against corrosion by the liquid can be achieved. The structure preferably includes the organic resin of 80% by mass or more, and more preferably includes the organic resin of 90% by mass or more. It is even more preferable if the structure includes the organic resin of 100% by mass, that is, the structure may be completely made of the organic resin.

Figure 6:
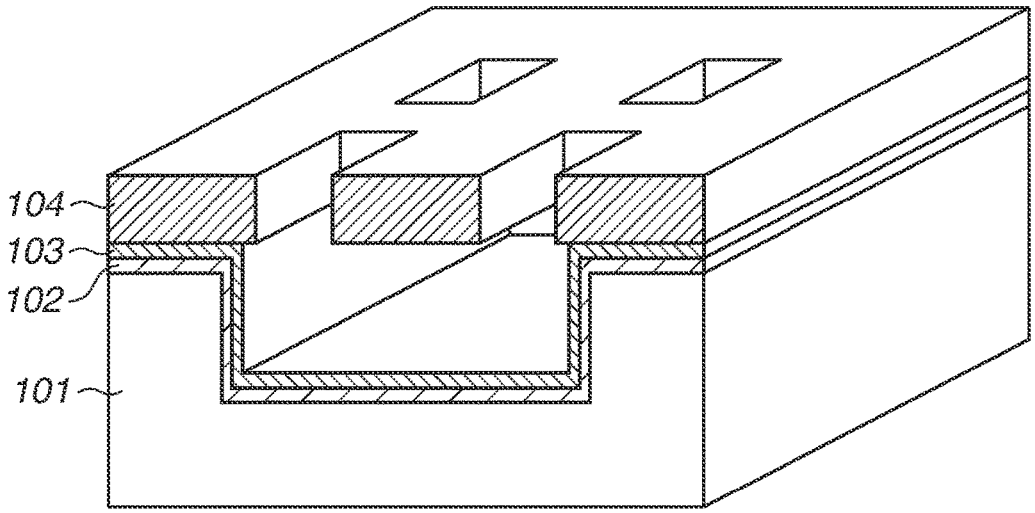
FIG. 6 is a cross-sectional view illustrating an example of a substrate according.

The structure may have a certain mechanical structure such as the liquid flow path. For example, preferably, recesses such as the flow path is formed on the first surface of the silicon substrate 101 and the structure 104 is a lid structure formed on the recess, as illustrated in FIG. 6. The lid structure may be provided with an opening that communicates with a part of the recess as illustrated in FIG. 6. For example, the structure may have a thickness that is equal to or larger than 10 μm and equal to or smaller than 1000 μm. The substrate illustrated in FIG. 6 may be provided with a through whole formed through the silicon substrate 101 from the first surface to the second surface, instead of the recess.

Figure 7:
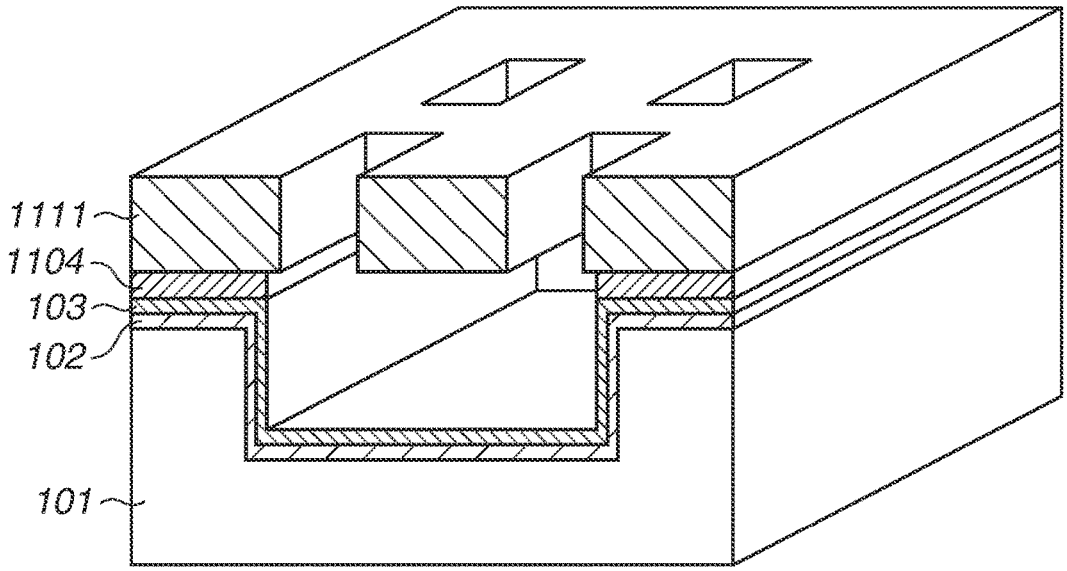
FIG. 7 is a cross-sectional view illustrating an example of a substrate.
Figure 8:
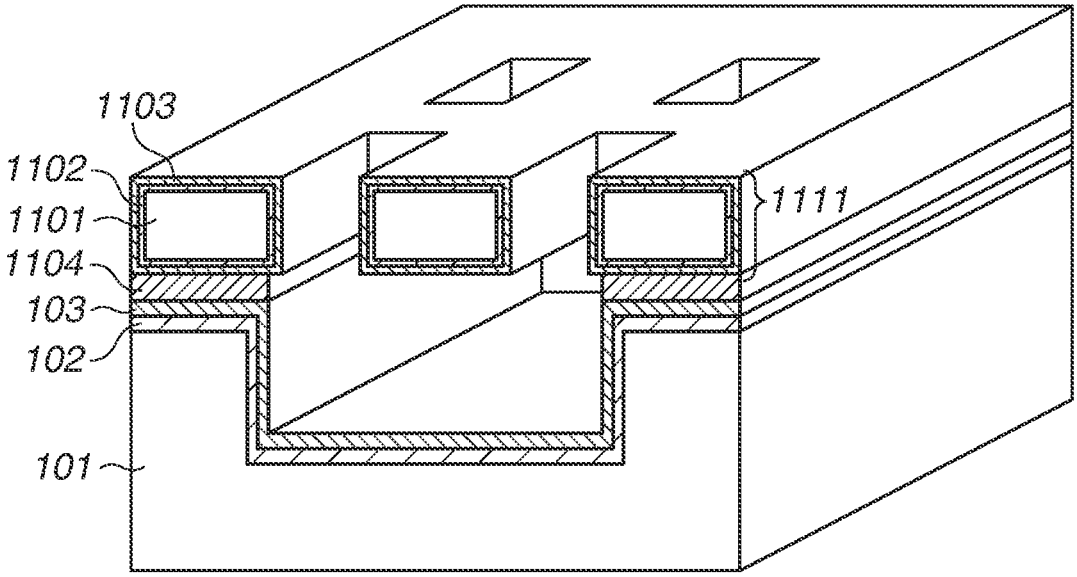
FIG. 8 is a cross-sectional view illustrating an example of a substrate.

Further, as illustrated in FIG. 7, a member 1111 may be joined to the silicon substrate 101 via a structure 1104. In such a configuration, the structure 1104 may be used as adhesive for adhering the member 1111. Meanwhile, in the case where the structure 1104 is not an adhesive, the structure 1104 and the silicon substrate 101 may be directly joined to each other by plasma activation after the organic resin in the structure 1104 has been cured. In any cases, the structure 1104 forms a part of the liquid flow path. The member 1111 is preferably a member with a lid structure formed in the recessed formed on the silicon substrate 101, as in the case of the structure 104 illustrated in FIG. 6. The member 1111 may be provided with an opening that communicates with a part of the recess as illustrated in FIG. 7. A material of the member 111 may be appropriately selected from various materials such as alumina, stainless steel (SUS), resin, and silicon. When a base material of the member 1111 is silicon, the member 1111 may have a similar structure as the silicon substrate 101 as illustrated in FIG. 8. More specifically, a surface of the base material (a silicon substrate 1101) may be covered with an insulating layer B 1102 and a protective layer B 1103 including metal oxide may be formed on the insulating layer B. In this configuration, the member 111 is an exemplary embodiment. When another member is to be further joined, this member may have the same configuration as the member 1111. A through hole may be formed through the silicon substrate illustrated in FIG. 7 and FIG. 8 from the first surface to the second surface, instead of a recess.

Figure 9:
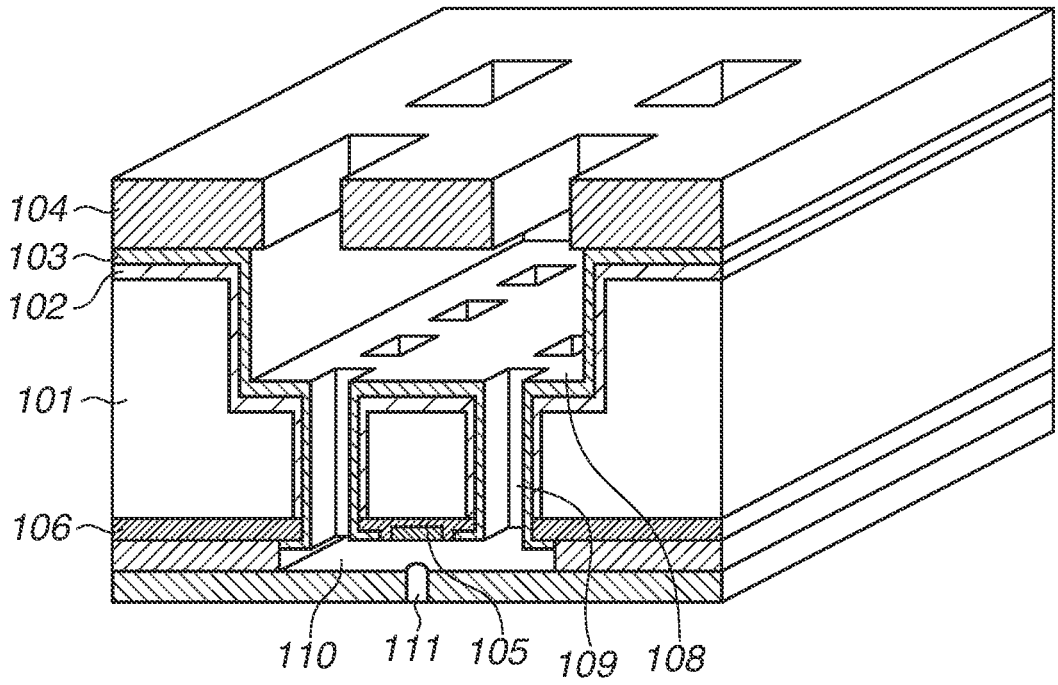
FIG. 9 is a cross-sectional view illustrating an example of a liquid discharge head.

FIG. 9 illustrates an example of a liquid discharge head. The liquid discharge head illustrated in FIG. 9 includes the insulating layer A 102 on a first surface of the silicon substrate 101, the protective layer A 103 on the insulating layer A 102, and a structure 104 on the protective layer A 103. An energy-generating element 105 and a wiring layer 106 including a driving circuit and wiring for supplying power to the energy-generating element 105 are formed on a second surface of the silicon substrate 101. A pressure chamber 110 incorporating the energy-generating element 105 and a liquid discharge port 111 are formed by the flow path forming member and the discharge port forming member formed on the second surface of the silicon substrate 101. The silicon substrate 101 has a liquid flow path 108, as a flow path structure, having an opening on the first surface. The flow path 108 on a first surface side communicates with the pressure chamber 110 via liquid supply paths 109. The structure 104 is a lid structure formed on the flow path 108. The lid structure has openings formed for communication with the flow path 108. The liquid supplied to the flow path 108 through the opening of the structure 104 flows to the pressure chamber 110 through the supply paths 109 to be held in the pressure chamber 110. Then, the liquid is discharged to the outside by energy provided from the energy-generating element 105.

With respect to a characteristic configuration of the liquid discharge head, adhesion reliability between the structure and the substrate, and between the flow path forming member and the substrate is very important. In a general inkjet printer, flow paths for multi-color ink are formed in the liquid discharge head for supplying multi color ink for forming a color image. For example, in a cross-sectional view of the liquid discharge head illustrated in FIG. 9, flow paths for different colors of ink adjacent to the flow path 108 are formed in a left and right direction of the cross-sectional view. Peeling from the substrate between the flow paths for different colors of ink leads to ink mixture, resulting in a failure to form a normal image.

In particular, a contact area between the substrate and the structure is smaller than that between the flow path forming member and the substrate. Thus, a slightest peeling of the structure from the substrate may lead to the mixing of different colors of ink. More specifically, in the liquid discharge head illustrated in FIG. 9, the flow path 108 needs to have a sufficient width for stably supplying liquid to multiple discharge ports 111 arranged in a direction orthogonal to the cross section. Thus, the width of the flow path 108 on the first surface of the silicon substrate 101 is preferably larger than the width of the pressure chamber 110 on the second surface of the silicon substrate 101. For example, the width of the pressure chamber 110 may be equal to or larger than 30 μm and equal to or smaller than 300 μm, whereas the width of the flow path 108 may be equal to or larger than 350 μm and equal to or smaller than 1000 μm. Thus, in this configuration, a portion of the silicon substrate 101 on the first surface side, where the flow path 108 is not formed in contact with the structure 104, has a larger width than a portion of the silicon substrate 101 on the second surface side in contact with the flow path forming member. Thus, high reliability is required for adhesion between the silicon substrate 101 and the structure 104 because the slightest peeling might result in the mixing of different colors of ink. Accordingly, it is important to provide the insulating layer A 102 as a layer on the first surface side of the silicon substrate 101.

The liquid in the pressure chamber can circulate between the inside of the pressure chamber 110 and the outside of the pressure chamber 110. More specifically, the liquid in the pressure chamber 110 may be discharged to the outside through any hole, and can return into the pressure chamber 110 through any hole. For example, the liquid in the pressure chamber 110 may circulate to the first surface side of the silicon substrate 101 via the supply paths 109 of the silicon substrate 101. More specifically, for example, in FIG. 9, the liquid may enter the pressure chamber 110 through the supply path 109 on the right side, enter the flow path 108 through the supply path 109 on the left side, and then return to the pressure chamber 110 through the supply path 109 on the right side. In FIG. 9, the left and right supply paths 109 are each a through hole extending toward the first surface side of the silicon substrate 101 from a single flow path 108. Alternatively, the flow path 108 may be divided into two sections on left and tight sides. In this configuration, the supply path 109 on the left side may extend from one of the flow paths, and the supply path 109 on the right side may extend from the other one of the flow paths. In such a configuration, the flow paths of the liquid can be separated and efficient liquid circulation can be achieved in a flow path through which the liquid flows into the pressure chamber 110 and a flow path through which the liquid flows out from the pressure chamber 110. In this case, the width of the flow path described above is the widths of the flow paths on the left and the right sides which are added together.

Figure 10:
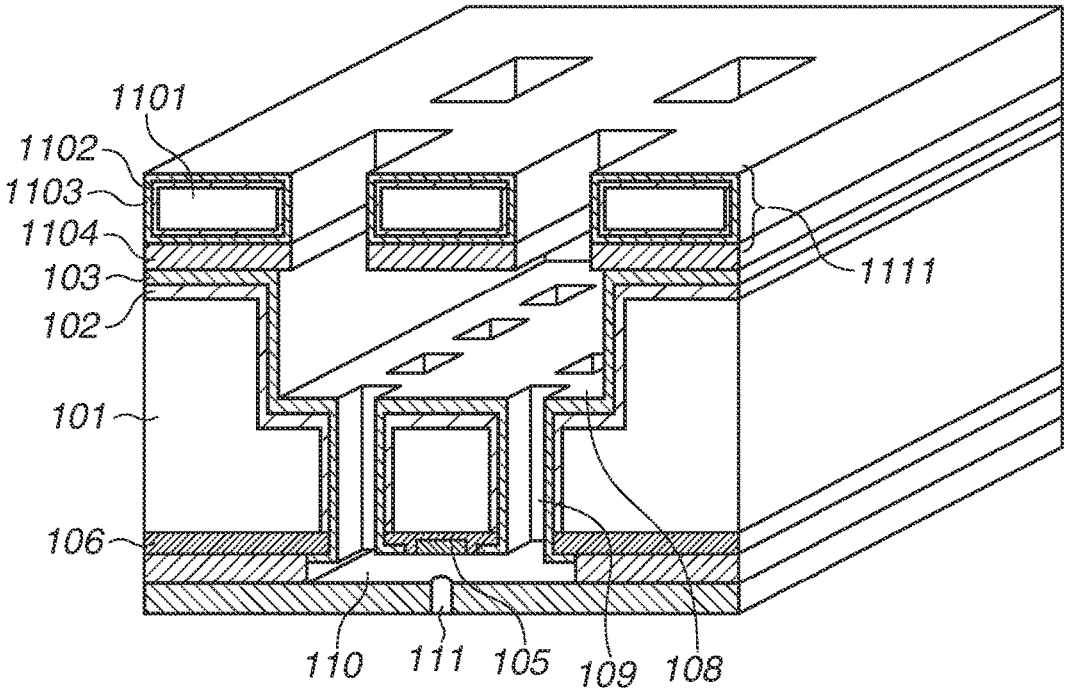
FIG. 10 is a cross-sectional view illustrating an example of a liquid discharge head.

FIG. 10 illustrates a liquid discharge head according to another example. The liquid discharge head in FIG. 10 has the same configuration as the liquid discharge head illustrated in FIG. 9 other than the structure and the member joined to the structure. In the liquid discharge head illustrated in FIG. 10, the member 1111 is joined via the structure 1104. This member 1111 may be the same as the member 1111 illustrated in FIG. 8. If a member other than the member 1111 is further joined, that member may have the same configuration as the member 1111.

[Manufacturing Method for Liquid Discharge Head]

A manufacturing method for a liquid discharge head according to the present disclosure includes forming the insulating layer A on the first surface of the silicon substrate by ALD, forming the protective layer A on the insulating layer A, and forming the structure on the protective layer A. An example of the manufacturing method for a liquid discharge head is described below with reference to FIG. 11 and FIG. 12.

Figure 11A:
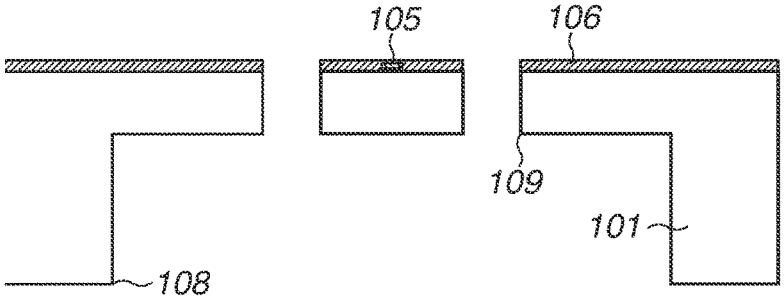
FIGS. 11A to 11E are cross-sectional views illustrating manufacturing steps of substrates according to Example and Comparative Example.

First of all, the silicon substrate 101 is prepared. The energy-generating element 105 as a heater and the wiring layer 106 including the driving circuit and the wiring for supplying power to the energy-generating element 105 are formed in advance on the second surface of the silicon substrate 101 (FIG. 11A). The liquid flow path 108 is formed on the first surface of the prepared silicon substrate 101 on the side opposite to the second surface. The liquid supply paths 109 that communicate with the flow path 108 from the second surface of the silicon substrate 101 are formed. The paths may be formed by methods such as dry etching, wet etching, laser processing, sandblast processing, and machining. The flow path 108 and the supply path 109 may be formed by the same method or by different methods. Either one of the flow path 108 and the supply path 109 may be first formed (FIG. 11A).

Figure 11B:
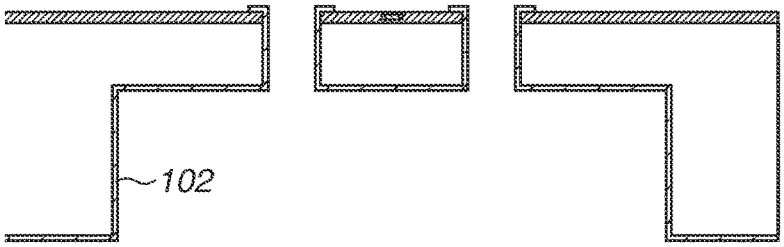

Next, the insulating layer A 102 is formed on the silicon substrate 101. As described above, the insulating layer A 102, which may be formed by a method selected from CVD, sputtering, and ALD, is preferably formed by ALD. Then, an unnecessary portion of the insulating layer A 102 thus formed is removed (FIG. 11B).

Figure 11C:
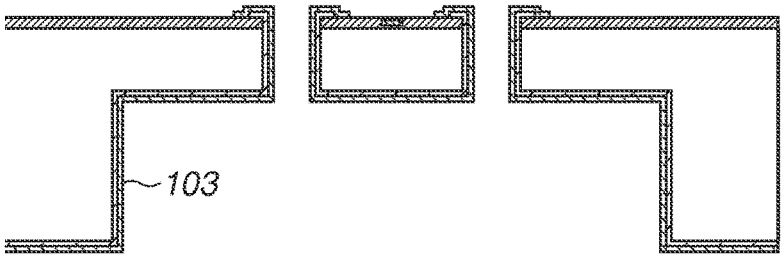

Then, a metal oxide film as the protective layer A 103 is formed on the silicon substrate 101 and on the insulating layer A 102. Then, the unnecessary portion of the protective layer A 103 thus formed is removed (FIG. 11C).

The insulating layer A 102 and the protective layer A 103 may not be removed if there is not unnecessary portion. Still, the layers A 102 and A 103 are preferably removed with respect to a portion on the energy-generating element 105 to achieve stable discharging and high energy efficiency. The protective layer A 103 for protecting the silicon from liquid corrosion, is not necessarily required on a portion where the substrate 101 and the liquid flow path forming member are adhering to each other and no contact is made between the silicon and the liquid, and thus is preferably removed at the portion. A method for removing the unnecessary portions of the insulating layer A 102 and the protective layer A 103 may be selected from methods such as forming a pattern with a photoresist and the like and performing dry etching or wet etching, or a liftoff method for forming a pattern before the insulating layer A 102 is formed and removing the unnecessary portion together with the pattern after the layer has been formed. The same removing method or different removing methods may be performed on the insulating layer A 102 and the protective layer A 103, and the removing may be omitted if possible when the unnecessary portion does not exist.

Figure 11D:
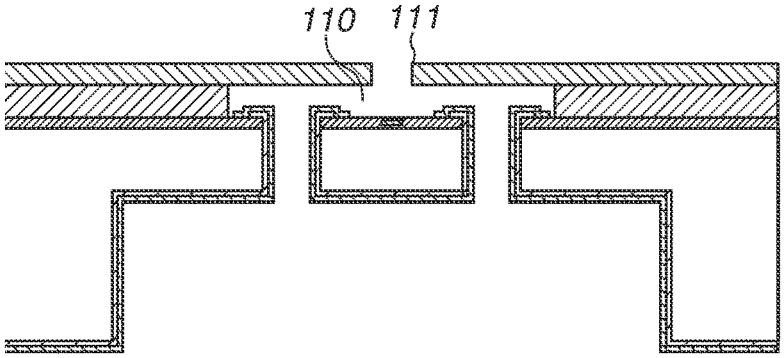

Then, the flow path forming member including the pressure chamber 110 extending from the supply path 109 to the discharge port 111 is formed (FIG. 11D). An example of a method for manufacturing the flow path forming member includes a method of repeating processes of laminating, exposing, and developing a photosensitive resin film. Another method is attaching a member made of organic resin and a member that is made of silicon together, which form the discharge port 111 and the pressure chamber 110 by etching and laser processing.

Figure 11E:
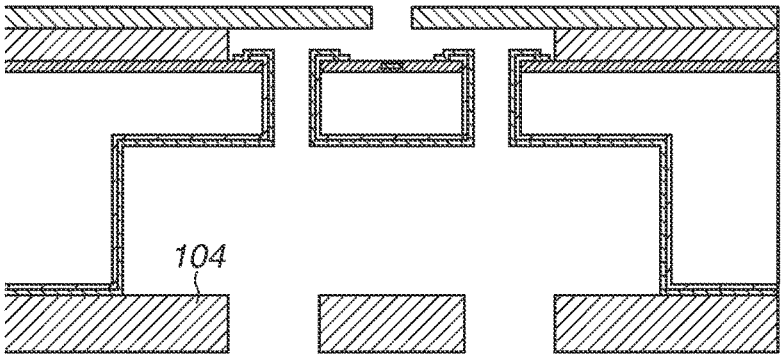

Next, the structure 104 as a lid structure in which the opening for communicating with the flow path 108 is formed is manufactured on the first surface of the silicon substrate 101. An example of a method for forming the structure 104 includes a method of laminating, exposing, and developing the photosensitive resin film (FIG. 11E). Another method is attaching the member made of silicon in which the opening is formed by etching and laser etching, through the structure 1104 as an adhesive layer (FIGS. 12A to 12D). When the member is made of silicon, the insulating layer 1102 and the protective layer 1103 are preferably formed on the member 1111 through the procedure described above (FIG. 12C). This configuration can prevent the member from being peeled from the adhesive layer and thus is highly preferable.

[Recording Method]

In a recording method according to the present disclosure, recording is performed with liquid including pigment discharged through the liquid discharge head. The recording method according to an exemplary embodiment involves the liquid discharge head according to the exemplary embodiment. Thus, the liquid including pigment can flow in the liquid discharge head without peeling at the interface between the protective layer A and the structure even when the liquid contained within the liquid discharge head has been circulating for a long time.

Figure 4A:
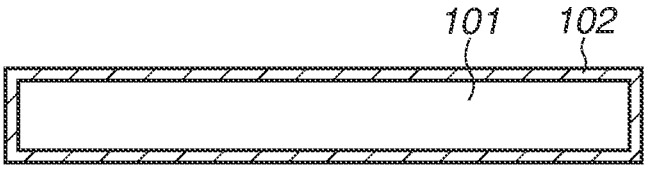
FIGS. 4A to 4D are cross-sectional views illustrating manufacturing steps of substrates according to Example and Comparative Example.

Example 1 is described below. In Example 1, a substrate was manufactured through a procedure illustrated in FIG. 4. First, the silicon substrate 101 was prepared. Then, a SiO film as the insulating layer A 102 with a thickness of 50 nm was formed by ALD (FIG. 4A).

Figure 4B:
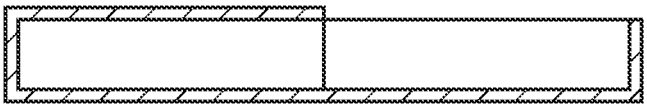

Then, both surfaces of the silicon substrate 101 were coated with photoresist (product name: THMR-iP5700HR, manufactured by TOKYO OHKA KOGYO., LTD.). An area corresponding to half the first surface of the silicon substrate 101 was irradiated with ultraviolet (UV) light for developing, whereby the insulating layer A 102 was partially exposed. Then, the substrate was immersed in semiconductor buffered hydrofluoric acid (product name: BHF-110U manufactured by DAIKIN INDUSTRIES, LTD.) so that exposed insulating layer A 102 was removed (FIG. 4B).

Figure 4C:
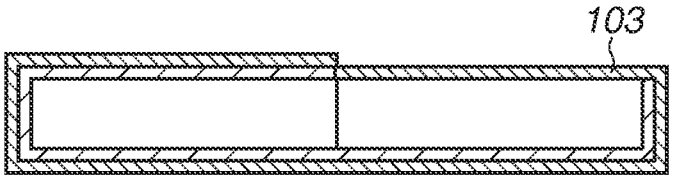
Figure 4D:
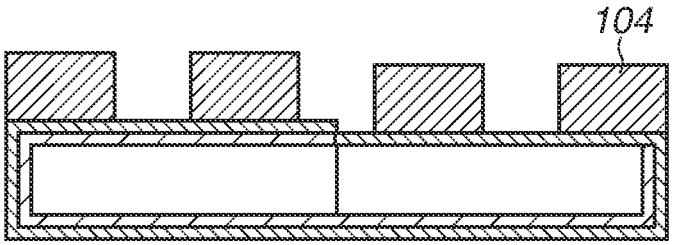

The photoresist was removed with a peeling solution, and then a TiO film as the protective layer A 103 with a thickness of 85 nm was formed by ALD (FIG. 4C). Then, the first surface was coated with epoxy resin (product name: TMMR, manufactured by TOKYO OHKA KOGYO., LTD.) as the structure 104. Then, a pattern of 200 μm×200 μm rectangular holes was formed with a photomask and an exposure device (a projection analyzer (product name: UX-4258, manufactured by USHIO INC.)) (FIG. 4D). Finally, the substrate was obtained with the epoxy resin completely cured by heating at 200° C.

The substrate was divided into pieces at a line drawn at the center of the silicon substrate 101 in FIG. 4D. A piece with the insulating layer A 102 formed on the first surface of the silicon substrate 101 was used as the substrate according to Example 1, whereas a piece with no insulating layer A 102 formed on the first surface of the silicon substrate 101 was used as a substrate according to Comparative Example 1. The substrates were immersed in pigment black ink (cartridge name: PFI-106 BK) for a large-format inkjet printer (product name: imagePROGRAF series) manufactured by Canon Inc. for two weeks while being heated at 70° C. The substrates were each taken out from the ink, washed by pure water, and then were observed with an electron microscope.

Figure 5A:
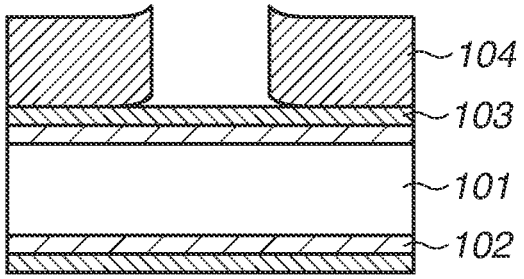
FIGS. 5A and 5B are cross-sectional views illustrating an ink immersion evaluation on substrates according to Example and Comparative Example.
Figure 5B:
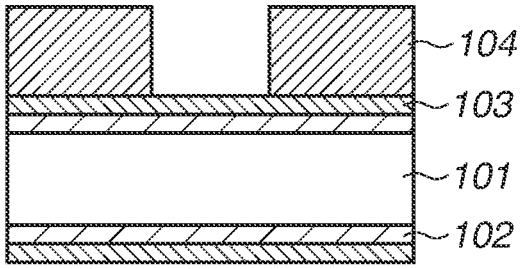

Peeling was found at a portion around the rectangular hole pattern formed on the structure 104, in the substrate according to Comparative Example 1, that is, the substrate with no insulating layer A 102 formed on the first surface of the silicon substrate (FIG. 5A). On the other hand, no change in the structure 104 was found in the substrate according to Example 1, that is, the substrate with the insulating layer A 102 formed on the first surface of the silicon substrate 101. Thus, in this substrate, no peeling of the structure 104 from the protective layer A 103 (FIG. 5B) has been found.

Example 2 is described below. A substrate of this example was manufactured in the same manner as Example 1 except that a SiN film was used as the insulating layer A 102 instead of the SiO film, and was subjected to the ink immersion evaluation. No change in the structure 104 as a result of the immersion in ink was found, and the structure 104 was not peeled from the protective layer A 103.

Example 3 is described below. A substrate of this example was manufactured in the same manner as Example 1 except that a SiOC film was used as the insulating layer A 102 instead of the SiO film, and was subjected to the ink immersion evaluation. No change in the structure 104 as a result of the immersion in ink was found, and the structure 104 was not peeled from the protective layer A 103.

Example 4 is described below. A substrate of this example was manufactured in the same manner as Example 1 except that a SiON film was used as the insulating layer A 102 instead of the SiO film, and was subjected to the ink immersion evaluation. No change in the structure 104 as a result of the immersion in ink was found, and the structure 104 was not peeled from the protective layer A 103.

Example 5 is described below. A substrate of this example was manufactured in the same manner as Example 1 except that an AlO film was used as the insulating layer A 102 instead of the SiO film, and was subjected to the ink immersion evaluation. No change in the structure 104 as a result of the immersion in ink was found, and the structure 104 was not peeled from the protective layer A 103.

Comparative Example 2

A substrate according to this comparative example was manufactured in the same manner as Example 1 except that a Ta film as a conductive material was formed by sputtering instead of the SiO film as the insulating layer A 102, and was subjected to the ink immersion evaluation. Peeling was found around the rectangular hole pattern formed in the structure 104.

Comparative Example 3

A substrate according to this comparative example was manufactured in the same manner as Example 1 except that a TiW film as a conductive film was formed by sputtering instead of the SiO film as the insulating layer A 102, and was subjected to the ink immersion evaluation. Peeling was found around the rectangular hole pattern formed in the structure 104.

Example 6 is described below. As in Example 1 and Comparative Example 1, the insulating layer A 102 and the protective layer A 103 were formed on the silicon substrate 101. Then, aromatic polyamide resin (product name: HIMAL HL-1200CH, manufactured by Hitachi Chemical Company, Ltd.) was applied to be heated and dried. Then, a photoresist (product name: THMR-iP5700 HR, manufactured by TOKYO OHKA KOGYO., LTD.) was further applied, and a pattern was formed using the photomask and the exposure device (a projection analyzer (product name: UX-4258, manufactured by USHIO INC.)). Then, the aromatic polyamide resin was etched by chemical dry etching using oxygen plasma, with the photoresist pattern used as the mask. Then, the photoresist was peeled, whereby the structure 104 with the pattern that is the same as Example 1 and Comparative Example 1 was formed. Then, the substrate was manufactured and the ink immersion evaluation was performed as in Example 1 and Comparative Example 1. A result of the evaluation was the same as Example 1 and Comparative Example 1.

TABLE 1

| | Insulating layer A (conductive film) | Protective layer A | Structure | Ink immersion evaluation result |
|---|---|---|---|---|
| Example 1 | SiO | TiO | Epoxy resin | No peeling |
| Comparative Example 1 | — | TiO | Epoxy resin | Peeled |
| Example 2 | SiN | TiO | Epoxy resin | No peeling |
| Example 3 | SiOC | TiO | Epoxy resin | No peeling |
| Example 4 | SiON | TiO | Epoxy resin | No peeling |
| Example 5 | AlO | TiO | Epoxy resin | No peeling |
| Comparative Example 2 | (Ta) | TiO | Epoxy resin | Peeled |
| Comparative Example 3 | (TiW) | TiO | Epoxy resin | Peeled |
| Example 6 | SiO | TiO | Aromatic polyamide resin | No peeling |
| Comparative Example 4 | — | TiO | Aromatic polyamide resin | Peeled |

Example 7 is described below. In this example, a liquid discharge head was manufactured through the procedure illustrated in FIG. 11. First, the silicon substrate 101 with a thickness of 625 μm was prepared (FIG. 11A). The energy-generating element 105 serving as the heater was formed in advance on the second surface of the silicon substrate 101. Similarly, the wiring layer 106 having the driving circuit and wiring for supplying power to the energy-generating element 105 was formed. The liquid flow path 108 as a recess with a depth of about 500 μm was formed on the first surface of the silicon substrate 101 on the side opposite to the second surface. In addition, the liquid supply paths 109 for communicating with the flow path 108 from the second surface of the silicon substrate 101 was formed.

Next, a SiO film as the insulating layer A 102 with a thickness of 20 nm was formed on the silicon substrate 101 by ALD. ALD was able to form the SiO film at a substantially uniform thickness on the inner walls of the flow path 108 and the supply paths 109. Then, a photoresist film was laminated on the second surface of the silicon substrate 101, and the photoresist pattern was formed only in a portion around the supply paths 109 using the photomask and an exposure device (product name: FPA-5510iV, manufactured by Canon Inc.). Then, the insulating layer A 102 on the second surface of the silicon substrate 101 was etched using the photoresist pattern as the mask. Buffered hydrofluoric acid (product name: BHF-110U manufactured by DAIKIN INDUSTRIES, LTD.) obtained by mixing semiconductor buffered hydrofluoric acid (product name: BHF-110U manufactured by DAIKIN INDUSTRIES, LTD.) and pure water at a ratio of 1:40 (volume ratio) was used as an etching solution. In this example, spin etching was employed by dropping the etching solution onto the rotated silicon substrate 101. Thus, only the unnecessary portion of the insulating layer A 102 was removed with no etching liquid spreading to the first surface of the silicon substrate 101. Then, the pattern used as the mask was removed (FIG. 11B).

Next, a TiO film as the protective layer A 103 with a thickness of about 77 nm was formed by ALD. ALD was able to form the TiO film at a substantially uniform thickness on the inner walls of the flow path 108 and the supply paths 109 as in the case of the insulating layer A 102. Next, the photoresist pattern was formed, and an unnecessary portion of the protective layer A 103 on the second surface of the silicon substrate 101 was etched using the photoresist pattern as the mask as in the case of the insulating layer A 102. Buffered hydrofluoric acid (product name: Pure Etch ZE250, manufactured by Hayashi Pure Chemical Ind., Ltd.) was used as an etching solution. Also in this example, the spin etching was employed by dropping the etching solution on the rotated silicon substrate 101. Thus, only the unnecessary portion of the protective layer A 103 was removed with no etching liquid spreading to the first surface of the silicon substrate 101. Then, the pattern used as the mask was removed (FIG. 11C).

Next, processes of laminating, exposing, and developing a photosensitive epoxy resin film (product name: TMMF, manufactured by TOKYO OHKA KOGYO., LTD.) were repeated twice. Thus, the flow path forming member including the liquid discharge port 111 and the pressure chamber 110 between the discharge port 111 and the supply path 109 was formed on the second surface side of the silicon substrate 101 (FIG. 11D).

Next, a photosensitive epoxy resin film was laminated on the first surface of the silicon substrate 101, exposed, and developed to form the structure 104 as the lid structure. In the structure 104, the opening for communicating with the flow path 108 was formed. The photosensitive epoxy resin film was manufactured by applying and drying an epoxy resin solution (product name: SU-8 2000, manufactured by Nippon Kayaku Co., Ltd.) on an optical film. Then, the liquid discharge head was obtained with the epoxy resin sufficiently cured through heating at 200° C. (FIG. 11E).

Next, the liquid discharge head was divided into pieces with a dicing saw. Then, the liquid discharge head was immersed in pigment black ink (cartridge name: PFI-106 BK) for a large-format inkjet printer (product name: image PROGRAF series) manufactured by Canon Inc. for two weeks while being heated at 70° C. The liquid discharge head was taken out from the ink, washed by pure water, and then was observed by an electron microscope. The structure 104 had not changed at all, and was not peeled from the protective layer A 103.

Comparative Example 5

A liquid discharge head was manufactured in a manner that is the same as Example 7 except that the insulating layer A 102 was not formed, and was subjected to the ink immersing evaluation. In this comparative example, the structure 104 was peeled at a portion around the flow path 108 which was in contact with the protective layer A 103.

Figure 12A:
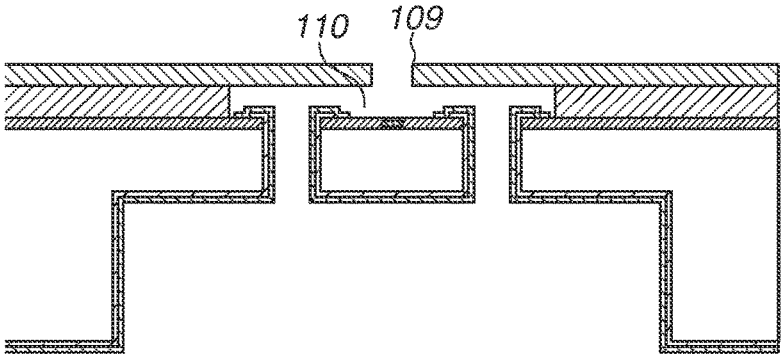
FIGS. 12A to 12D are cross-sectional views illustrating manufacturing steps of substrates according to Example and Comparative Example.
Figure 12B:
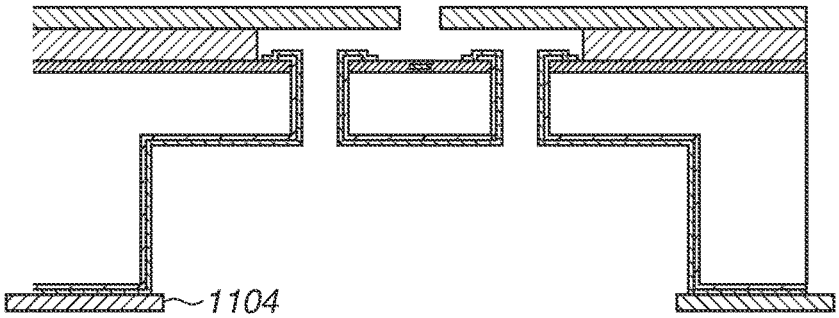

Example 8 is described below. In this example, a liquid discharge head was manufactured through a procedure illustrated in FIG. 12. First, the liquid discharge head in the state illustrated in FIG. 11D was manufactured in a manner that is similar to that in Example 7 (FIG. 12A). Then, the structure 1104 as the organic resin layer was formed on the first surface of the silicon substrate 101 (FIG. 12B). The structure 1104 was formed by applying a benzocyclobutene resin solution (product name: CYCLOTENE, manufactured by The Dow Chemical Company) to form a layer with a thickness of 2 μm on a silicon wafer, and then transferring the resultant layer onto the first surface of the silicon substrate 101

Figure 12C:
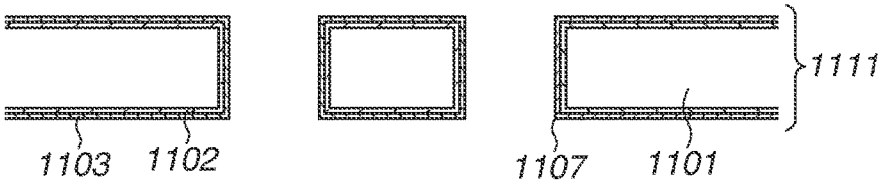

Next, the member 1111 was prepared (FIG. 12C). The member 1111 was formed with the insulating layer B 1102 as the $SiO_2$ film and the protective layer B 1103 as the TiO film which were formed on the silicon substrate 1101 with a thickness of 625 μm. The liquid supply paths 1107 were formed as through holes in the silicon substrate 1101.

Figure 12D:
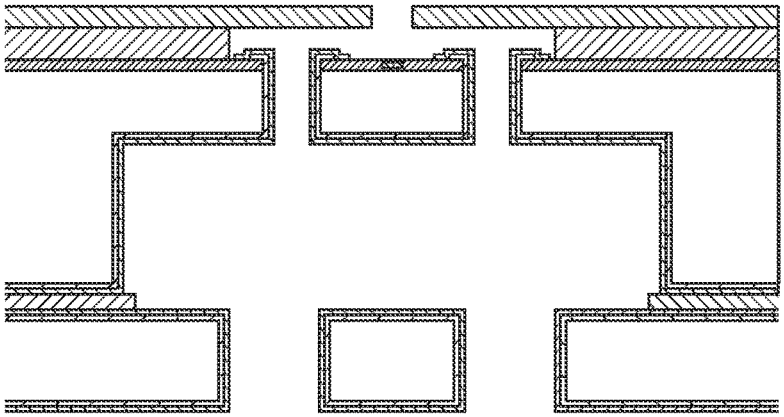

Next, the surface of the silicon substrate 101 on which the structure 1104 was formed was joined with the member 1111 (FIG. 12D). The substrate and the member were aligned with EVG6200BA (product name) manufactured by EV Group and were joined to each other using EVG520IS (product name) manufactured by EV Group. The joining was performed by heating at 150° C., and then the resin was sufficiently cured through further heating at 300° C. Thus, the liquid discharge head was obtained.

Next, the liquid discharge head was divided into pieces with a dicing saw. Then, the liquid discharge head was immersed in pigment black ink (cartridge name: PFI-106 BK) for a large-format inkjet printer (product name: imagePROGRAF series) manufactured by Canon Inc. for two weeks while being heated at 70° C. The liquid discharge head was taken out from the ink, washed by pure water, and then was observed by an electron microscope. The structure 104 had not changed at all, and the structure 104 was not peeled from the protective layer A 103.

Comparative Example 6

A liquid discharge head was manufactured in the same manner as Example 8 except that the insulating layer A 102 was not formed, and was subjected to the ink immersion evaluation. In this Comparative Example, peeling occurred when force was applied to each of the joined substrates. Ink immersion was found by observing the interface between the silicon substrate 101 and the structure 1104 that has been peeled, with an electron microscope.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-106234, filed May 27, 2016, which is hereby incorporated by reference herein in its entirety.

What is claimed is:

1. A liquid discharge head comprising:

a silicon substrate;

an insulating layer A formed on a first surface of the silicon substrate;

a protective layer A that includes metal oxide and is formed on the insulating layer A;

a structure that is formed on the protective layer A by direct contact with the protective layer A, includes organic resin, and forms a part of a flow path for liquid; and an element that is formed on a second surface of the silicon substrate on a side opposite to the first surface, and is configured to generate energy used for discharging the liquid.

2. The liquid discharge head according to claim 1, wherein the metal oxide includes titanium as a metal element.

3. The liquid discharge head according to claim 1, wherein the insulating layer A includes at least one compound selected from a group consisting of SiO, SiN, SiOC, SiON, and SiOCN.

4. The liquid discharge head according to claim 1, wherein the insulating layer A includes aluminum oxide.

5. The liquid discharge head according to claim 1, wherein the organic resin includes at least one resin selected from a group consisting of epoxy resin, aromatic polyimide resin, aromatic polyamide resin, and aromatic hydrocarbon resin.

6. The liquid discharge head according to claim 1, wherein the insulating layer A prevents the silicon substrate and the protective layer A from directly contacting each other.

7. The liquid discharge head according to claim 1, wherein a volume resistivity of the insulating layer A is larger than a volume resistivity of the protective layer A.

8. The liquid discharge head according to claim 7, wherein the volume resistivity of the insulating layer A is larger than the volume resistivity of the protective layer A by 10 Ωcm or more.

9. The liquid discharge head according to claim 1, wherein a thickness of the insulating layer A is 1 nm to 1 μm, and wherein a thickness of the protective layer A is 5 nm to 500 nm.

10. The liquid discharge head according to claim 1, further comprising a pressure chamber that incorporates the element, wherein the silicon substrate has a flow path having an opening on the first surface.

11. The liquid discharge head according to claim 10, wherein liquid within the pressure chamber circulates between the inside of the pressure chamber and the outside of the pressure chamber.

12. The liquid discharge head according to claim 11, wherein the flow path communicates with the pressure chamber via a supply path formed in the silicon substrate, and wherein the liquid within the pressure chamber circulates to the first surface side via the supply path.

13. The liquid discharge head according to claim 10, wherein a width of the flow path on the first surface of the silicon substrate is larger than a width of the pressure chamber on the second surface of the silicon substrate.

14. The liquid discharge head according to claim 10, wherein the structure is a lid structure formed on the flow path of the silicon substrate.

15. The liquid discharge head according to claim 10, wherein a member having a configuration for communicating with the flow path of the silicon substrate is joined to the silicon substrate via the structure.

16. The liquid discharge head according to claim 15, wherein a base material of the member is silicon, wherein a surface of the member is covered with an insulating layer B, and wherein a protective layer B including metal oxide is formed on the insulating layer B.

17. The liquid discharge head according to claim 1, wherein a thickness of the structure is equal to or larger than 10 μm and is equal to or smaller than 1000 μm.

* * * * *